US005850909A

United States Patent [19]

Wagner

[11] Patent Number: 5,850,909

[45] Date of Patent: Dec. 22, 1998

[54] SWITCH MECHANISM FOR SERVICE DISCONNECT

[76] Inventor: Brian L. Wagner, 7509 Oakland Hills Dr., Ypsilanti, Mich. 48197

[21] Appl. No.: 821,764

[22] Filed: Mar. 20, 1997

[51] Int. Cl.[6] ..... H01H 3/40

[52] U.S. Cl. ..... 200/501; 200/539

[58] Field of Search ..... 200/501, 539, 200/538, 537, 540, 541, 342, 523, 524

[56] References Cited

U.S. PATENT DOCUMENTS

| | | | |
|---|---|---|---|
| 3,395,379 | 7/1968 | Haggard . | |
| 4,758,696 | 7/1988 | Grazer | 200/510 |
| 4,778,961 | 10/1988 | M'Sadoques et al. . | |
| 5,408,061 | 4/1995 | Martin | 200/539 |
| 5,605,225 | 2/1997 | Schaeffer | 200/539 |

*Primary Examiner*—David J. Walczak
*Attorney, Agent, or Firm*—Young & Basile, P.C.

[57] ABSTRACT

A switch mechanism for electrical service quick connect/disconnect, especially suitable for electric vehicles. The switch mechanism includes a handle for turning a shaft which, through a lost motion connection, rotates a gear in engagement with a rack. The rack moves the switch contacts from a disconnect to a connect position to make and break electrical connection between the vehicle battery pack and the vehicle electrical system. An over center device biases the handle into either a full connect or a full disconnect position once the handle passes an intermediate position. A spring forces a locking detent into a notch on the rack to prevent inadvertent movement of the rack from the connect position, and a cam mounted on the shaft actuates a cam follower portion of the locking detent to move the locking detent out of the notch and allow the rack to move to its disconnect position. Further springs are compressed in response to movement of the contacts to their connect position. Once the locking detent releases the rack, the further springs quickly and positively snap the contacts to the disconnect position. The lost motion connection between the shaft and the gear requires the handle to be moved to an intermediate position before movement of the contacts is initiated in either a connect or disconnect direction. The lost motion connection also allows the snapping movement of the contacts to their disconnect position upon release of the detent.

30 Claims, 8 Drawing Sheets

SWITCH MECHANISM FOR SERVICE DISCONNECT

BACKGROUND OF THE INVENTION

This invention relates generally to switch mechanisms and more specifically to a switch mechanism for quickly and easily connecting or disconnecting the electrical system of an electric vehicle from the vehicle battery.

In situations where a high current power source must be periodically connected and disconnected from an electrical system, it is imperative that the disconnect operation be performed in a rapid and decisive manner to avoid the overheating that might otherwise occur if the contact surface area was significantly reduced without actually achieving a full disconnect. For example, in an electric motor vehicle having a battery pack and an electrical system powered by the battery pack, it is necessary that the battery pack be disconnected from the power source for servicing purposes or in the event of an accident and it is desirable that the disconnect operation occur in a rapid, decisive manner to avoid overheating as the contacts are separated to achieve the disconnect.

Various switch mechanisms, such for example, as the mechanisms of U.S. Pat. Nos. 3,395,379 and 4,778,961, have been proposed to perform connect/disconnect functions in an electrical system. These prior art switch mechanisms are generally satisfactory when operating in their intended specific design environments, but are not satisfactory when employed as the connect/disconnect switch in an electric vehicle. Specifically, they do not provide sufficiently rapid disconnect to avoid overheating; and/or they require an excessive amount of torque to operate; and/or they are susceptible to leaving the switch in an intermediate position in which the power source and electric system are only partially connected.

SUMMARY OF THE INVENTION

It is an object of the invention to provide an improved switch mechanism for an electrical service connect/disconnect system.

A more specific object is to provide a switch mechanism which provides positive/rapid disconnect.

A yet further object is to provide a switch mechanism which requires a minimal force to achieve a disconnect.

A yet further object is to provide a switch mechanism for an electrical service connect/disconnect device in which it is possible to position the switch only in a full disconnect or a full connect position.

The switch mechanism of the invention is of the type including a contact mounted for movement between a closed position in which an associated circuit is closed an open position in which the circuit is open, actuator means moveable in a switch open direction and a switch closed direction, and drive means operative in response to movement of the actuator means in a switch closed direction to move the contact from its open to its closed position.

According to the invention, biasing means are provided which are operative in response to movement of the contact to its closed position to generate a force biasing the contact toward its open position, detent means are provided which are operative in response to arrival of the contact at its closed position to prevent movement of the contact to its open position irrespective of the biasing force, and release means are provided which are operative in response to movement of the actuator means in a switch open direction to release the detent means to allow the biasing force to move the contact to its open position. This arrangement allows the contact to be moved to its open, disconnect position in a rapid, precise manner.

According to a further feature of the invention, the drive means includes a driven member moving with the contact, the actuator means includes a driving member, and a lost motion connection is provided between the driving and driven members which is operative to allow movement of the driven member relative to the driving member. This arrangement allows the contact to move freely to its open position under the biasing force without resistance from the actuator means.

According to a further feature of the invention, the actuating means includes a shaft; the drive means includes a gear mounted on the shaft and a rack driven by the gear; the detent means includes a notch in the rack and a detent operative to engage the notch in response to movement of the contact to its closed position; and the release means includes a cam member carried by the shaft and operative to release the detent from the notch in response to rotation of the shaft. With this arrangement, rotation of the shaft in a connect direction moves the contact to its closed position to close the circuit while the detent operates to lock the contact in its closed position, and subsequent rotation of the shaft in an opposite, disconnect direction functions to release the detent from the notch and allows the contact to be moved to its disconnect position under the biasing force.

According to a further feature of the invention, the switch mechanism includes a handle mounted for movement between an open position corresponding to the open position of the contact, a closed position corresponding to the closed position of the contact, and an intermediate position; and the switch mechanism includes resilient means operative to urge the handle toward its open position in response to movement of the handle from its open toward its closed position and operative to urge the handle toward its closed position upon passage of the handle through its intermediate position. This arrangement insures that the switch mechanism will always be moved in a positive manner to either its full connect or full disconnect position, thereby avoiding inadvertent or partial actuation of the switch mechanism.

According to a further feature of the invention, the handle is secured to the shaft and is mounted for pivotal movement about the pivot axis of the shaft between its open, closed, and intermediate positions, and the resilient means includes a spring having a line of action which passes over center with respect to the pivot axis of the shaft as the handle passes through its intermediate position. This arrangement provides a simple and effective means of insuring that the switch mechanism will always move to either its full connect or full disconnect position.

The invention also provides a method of performing a switching operation in a switch mechanism of the type including a contact mounted for movement between open and closed positions, actuator means moveable between switch open and switch closed directions, and drive means operative in response to movement of the actuator means in a switch closed direction to move the contact from its open to its closed position.

According to the invention, the actuator member is moved in a switch closed direction to move the contact from its open to its closed position; a force is generated biasing the contact toward its open position in response to movement of the contact to its closed position; the contact is lockingly engaged in response to arrival of the contact at its closed position to prevent movement of the contact to its open position irrespective of the biasing force; and the contact is released in response to movement of the actuator means in a switch open direction to allow the biasing force to move the contact to its open position. This methodology provides a rapid precise movement of the contact to a switch open or disconnect position.

According to a further feature of the invention methodology, the method further includes the step of providing a lost motion connection in the drive means operative to allow the contact to be moved freely to its open position by the biasing force without resistance from the actuator means.

DETAILED DESCRIPTION OF THE PREFERRED EMBODIMENT

The switch mechanism of the invention is intended for use in connecting and disconnecting an electrical system from a power source. For example, the invention switch mechanism is especially suitable for use in connecting and disconnecting a vehicular electrical system from a vehicular power source such as a battery pack for vehicle servicing purposes.

Figure 1:
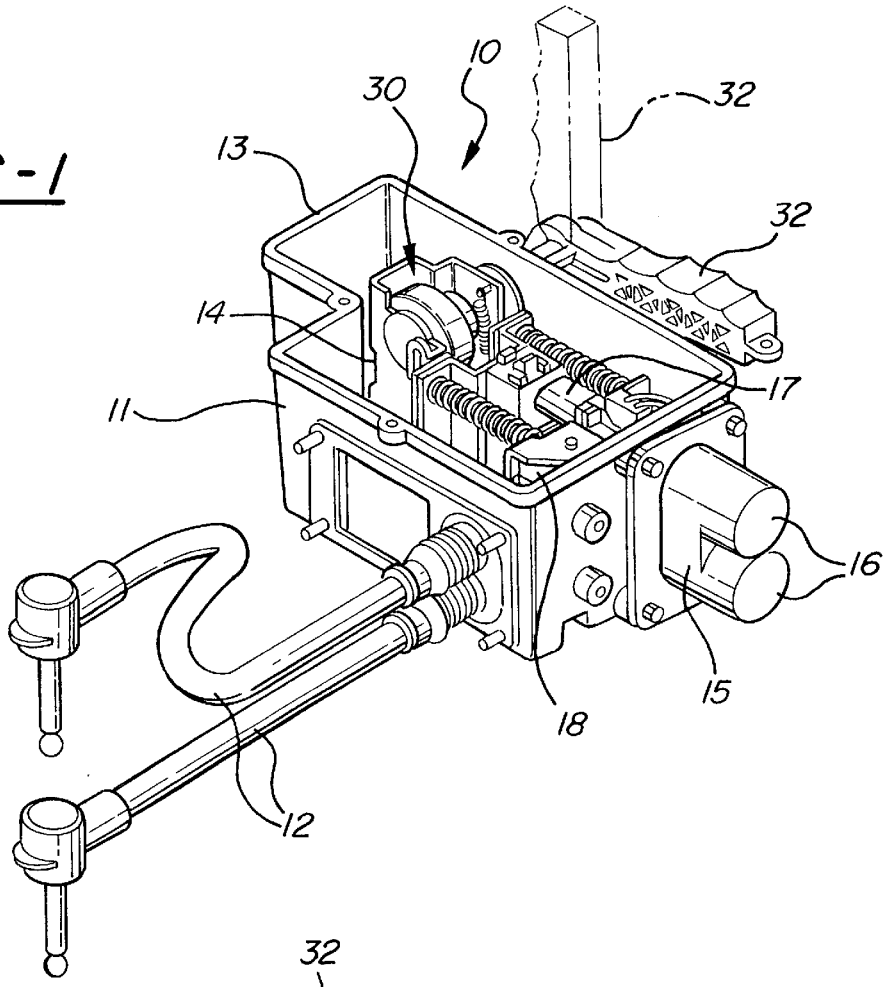
FIG. 1 is a perspective view of a switch mechanism according to the invention shown in a disconnect position.

With reference to FIG. 1, switch mechanism 10 includes a housing 11. Two battery cables 12 from positive and negative battery leads extend through a grommet into the housing 11. A cover (not shown) has been removed from the switch mechanism 10 to show its inner workings. A seal 13 along and within an edge of the housing 11 provides a waterproof seal between the housing and its cover. When installed in a vehicle, the switch mechanism would actually be inverted relative to the switch disposition shown in FIG. 1. However, for purposes of this description, the lower wall of the housing as it is disposed in FIG. 1 will be referred to as a base 14.

Figure 2:
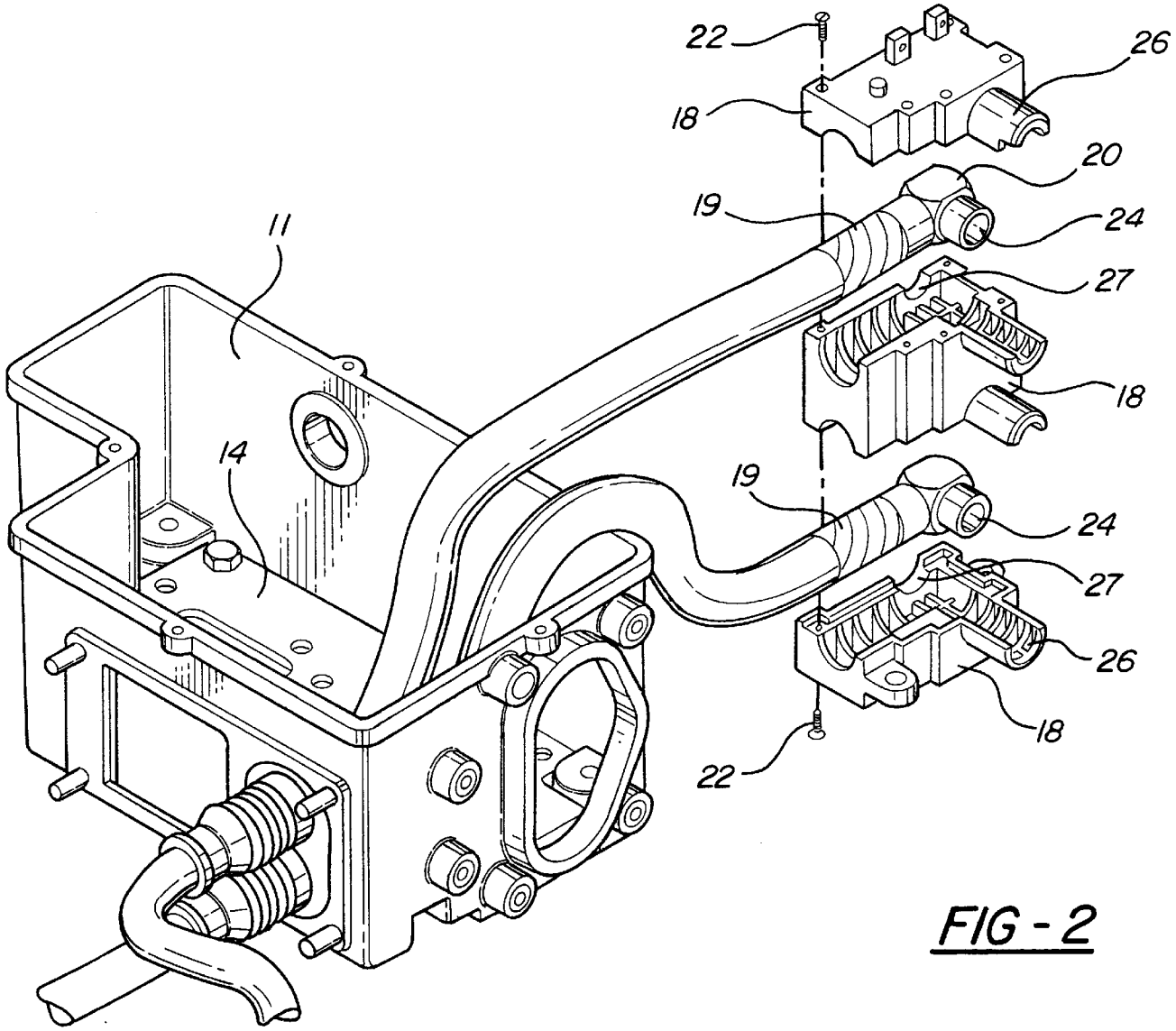
FIG. 2 is an exploded perspective view of a battery coupler subassembly utilized in the switch mechanism.
Figure 3:
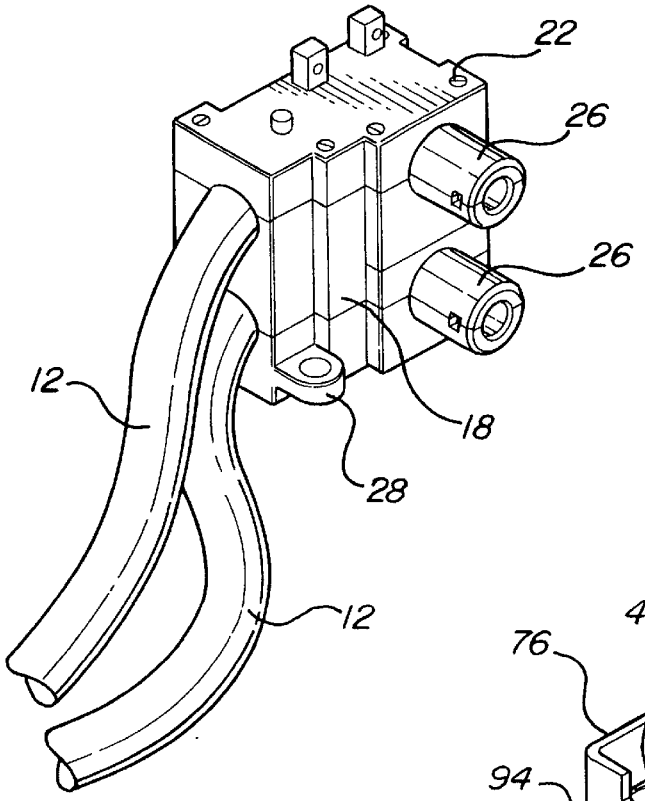
FIG. 3 is a perspective view of the battery coupler subassembly in an assembled condition.

Switch mechanism 10 includes a connector housing 15 with terminal receiving chambers 16 for receiving electrical terminals or contacts (not shown) from a vehicle electrical system. Chambers 16 also receive male contacts or terminals 17 through a three-piece insulator battery coupler subassembly 18. The subassembly 18 is shown in exploded form in FIG. 2 and in assembled form in FIG. 3. Battery cable ends 19 with attached couplers 20 are clamped within subassembly 18 when the pieces are connected by screws 22 such that annular passageways 24 of the couplers 20 align and communicate with integral cylindrical extensions 26 projecting from the subassembly and circular openings 27 into the subassembly. Subassembly 18 is mounted within the housing 11 to the base 14 adjacent connector housing 15 by bolts (not shown) and mounting tabs 28.

A switch mechanism subassembly 30 is used to position the male contact terminals 17 to electrically connect or disconnect the battery couplers 20 with electrical terminals from the vehicle electrical system within the terminal receiving chamber 16 of the connector housing 15.

Figure 4:
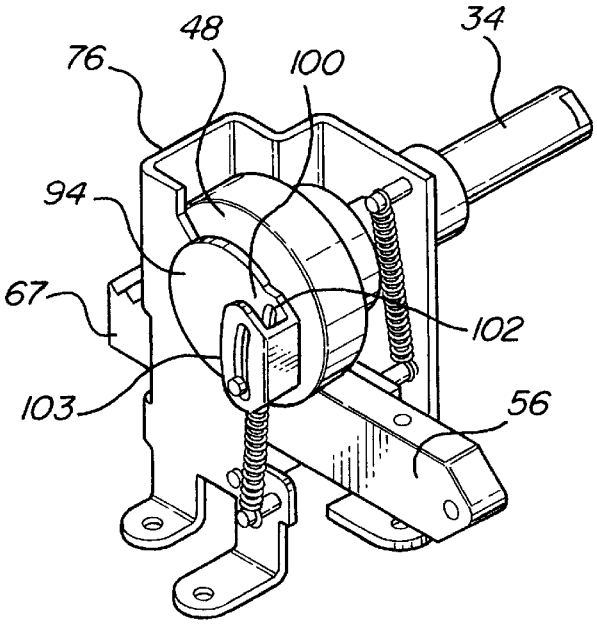
FIG. 4 is a fragmentary perspective view of a switch mechanism subassembly.
Figure 5:
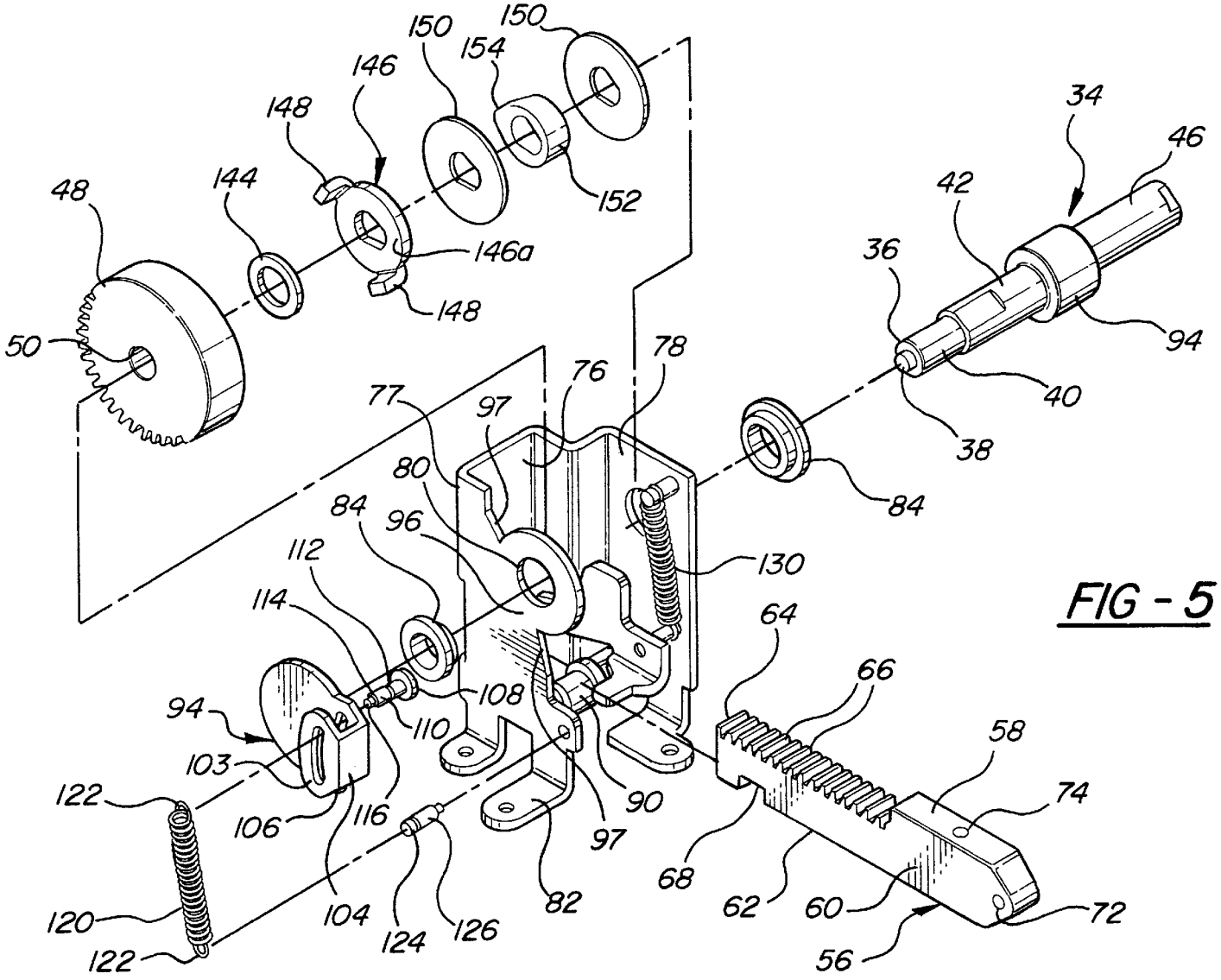
FIG. 5 is an exploded perspective view of the switch mechanism subassembly.
Figure 7:
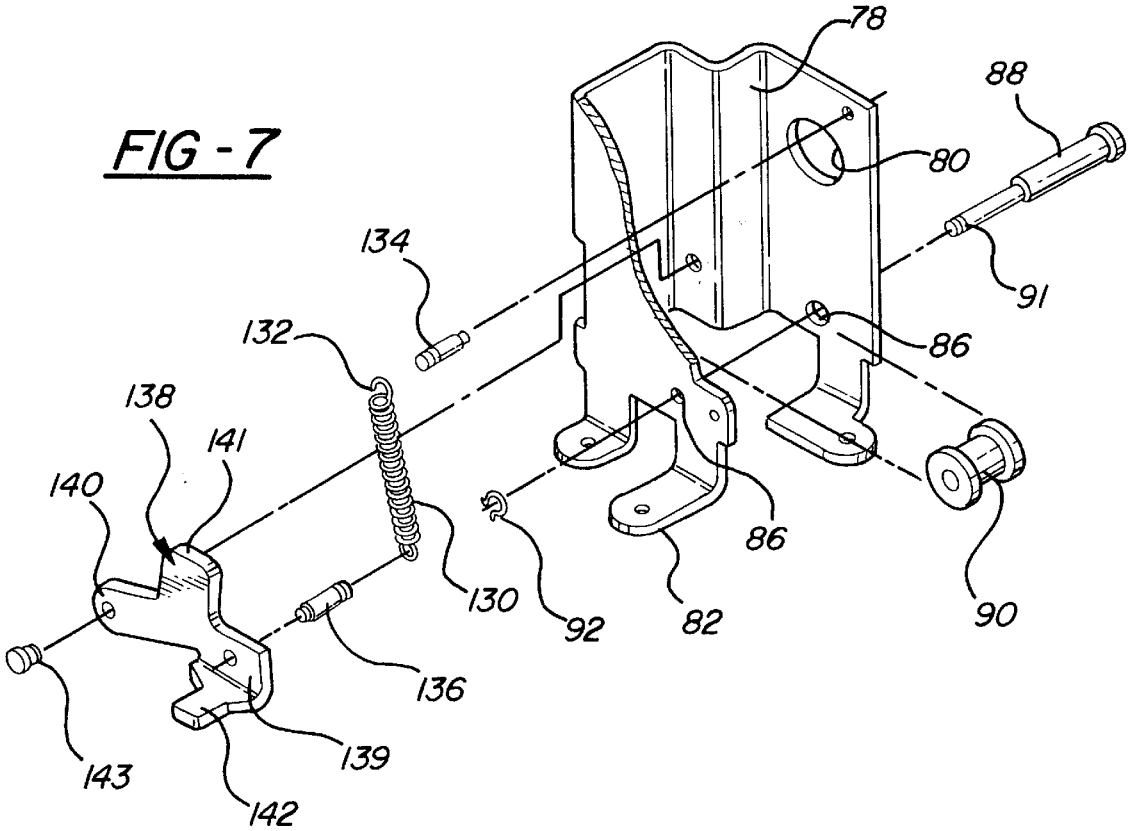
FIG. 7 is an exploded perspective view of a frame and related components utilized in the switch mechanism.
Figure 8:
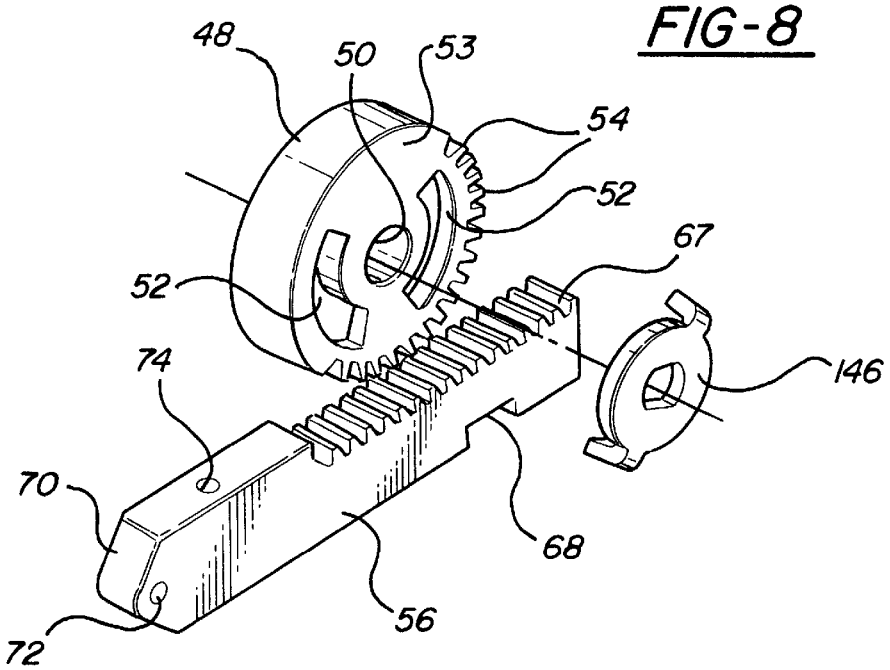
FIG. 8 is an exploded perspective view showing details of a drive mechanism employed in the switch mechanism.

Switch mechanism subassembly 30 includes a lever or handle 32 which rotates a shaft 34 as best illustrated in FIG. 4. Handle 32 is contoured so that it can be easily and comfortably gripped. FIGS. 5, 7 and 8 are exploded views illustrating components of the switch mechanism in further detail. Shaft 34 has an end 36 distal from the handle 32 (FIG. 5). A short half cylindrical knob 38 extends from the end 36. Back along its length from the knob 38, shaft 34 includes a gear journal section 40, a slightly larger oblong or otherwise non-circular longer component support section 42, a large diameter section 44, and a handle attach section 46. Switch mechanism subassembly 30 further includes a pinion gear 48. Pinion gear 48 has a central aperture 50 (FIG. 8) for receiving the gear journal section 40 of shaft 34 and two arcuate slots 52 in the surface 53 of the gear facing handle 32. Arcuate slots 52 are located on opposite sides of central aperture 50. Pinion gear 48 includes peripheral teeth 54 which are used to drive a gear rack 56 back and forth in a linear reciprocating fashion within the switch mechanism according to the direction in which handle 32 is pivoted.

Gear rack 56 includes an upper surface 58 (FIG. 5), side surfaces 60, and an under surface 62. Gear teeth 66 are provided on upper surface 58 proximate one end 67 of the rack. Teeth 66 mesh with pinion gear teeth 54. On under surface 62 adjacent rack end 67 and beneath gear teeth 66 is a rectangular detent notch 68 (FIG. 8). Adjacent the opposite end 70 of rack 56 an aperture 72 extends through the rack and a threaded hole 74 extends into the rack from upper surface 58.

Shaft 34, pinion gear 48, and gear rack end 67 are supported within the switch mechanism by a frame 76. Frame 76 includes two spaced upstanding arm sections 77 and 78. Shaft 34 extends through an aperture 80 in each arm section. Frame 76 is secured to base 14 by screws or bolts (not shown) extending through mounting tabs 82 into threaded holes within the base. Bushings 84, mounted within and around the edges of each aperture 80, allow smooth rotation of the shaft 34 relative to frame 76. A small hole 86 in the lower part of each arm section 77 and 78 receives a roller pin 88 extending through a roller 90. Roller 90 rollably supports end 67 of gear rack 56. Roller pin 88 has an annular groove 91 adjacent one end and an E-ring 92 fits into the groove 91 to secure the roller pin and roller in the frame after the roller pin has been inserted through the small hole 86 in arm section 77.

A circular metal plate stopper 94 is mounted slightly spaced from a projection 96 extending from arm section 77. Projection 96 is in the same plane as arm section 77 and has a round shape which blends into edges 97 of arm section 77 approximately perpendicular to the round shape at each end of its circumference. Plate stopper 94 has a semi-circular central aperture which receives the half cylindrical knob 38 of shaft 34 so that the plate stopper 94 rotates with the shaft. The rim of bushing 84 spaces stopper 94 a short distance from the facing surface of projection 96. An E-ring or a cotter pin or some other known securing device or method can be used to keep plate stopper 94 from separating from knob 38.

Figure 6:
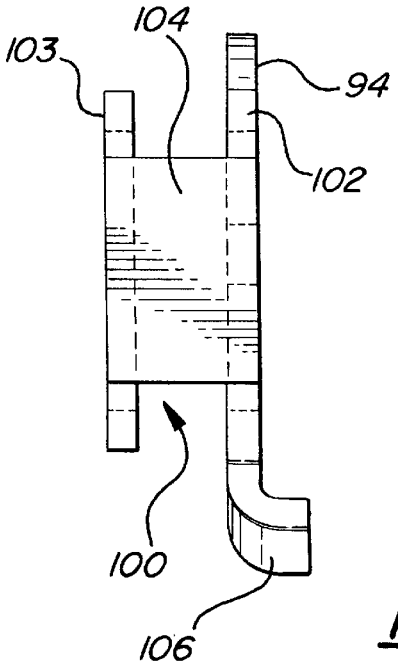
FIG. 6 is an enlarged side view of a plate stopper used in the switch mechanism.

As illustrated in FIG. 6, plate stopper 94 also includes a channel 100 at one side with facing inner and outer walls 102 and 103. Inner wall 102 is in the plane of the main part of plate stopper 94. Outer wall 103 is separated from the main body of the stopper by an extension wall 104 which extends perpendicularly away from wall 102, thereby forming channel 100. Walls 102 and 103 have matching slots 105. Plate stopper 94 includes a protrusion 106 adjacent the extension wall 104 bent in the opposite direction from the direction the extension wall 104 extends. Protrusion 106 abuts against edges 97 to define the arc of rotation for plate stopper 94. Edges 97 form stops to limit the rotation of plate stopper 94 and thereby limit the rotation of handle 32 at each end of the circumference of projection 96.

A bridging pin 107 has a head 108 and a shank 110. Bridging pin 107 extends through slots 105 and across channel 100. An annular notch 112 extends around the shank approximately midway along its length and an additional annular notch 114 is located at an end 116 of the shank distal from head 108. Notch 114, with the aide of an E-ring or the like, secures the end 116 of the pin 107 in outer channel wall 103. Head 108 of pin 107 abuts against the surface of the inner channel wall 102 facing away from channel 100. Pin 107 is not attached to the arm section 77 of frame 76. Head 108 of pin 107 is thin enough not to interfere with the rotation of plate stopper 94. Since stopper 94 is spaced from the facing surface of projection 96 by the rim of bushing 84, the head of the pin does not contact projection 96.

A coil spring 120 has an attaching loop 122 at each end. One attaching loop 122 is fitted within the annular notch 112 in bridging pin 107. The other attaching loop 122 is fitted in an annular notch 124 in a stationary pin 126 extending from a lower part of the frame arm section 77. Annular notch 124 is spaced from arm section 77 such that coil spring 120 extends generally vertically.

A second coil spring 130 is attached to the other frame arm section 78. An attaching loop 132 at a top end of spring 130 is secured to the top portion of arm section 78 by a stationary pin 134 similar to pin 126. The attaching loop at the lower end of spring 130 is attached to a pin 136. Pin 136 is secured at its opposite end to a lock member 138. Lock member 138 has a free end 139 carrying pin 136, a pivotally mounted end 140, and a cam follower portion 141. Free end 139 includes a lower detent tab 142 extending perpendicularly from the plane of the main body of the lock member. End 140 is pivotally mounted on arm section 78 by a pin 143.

Pinion gear 48 is freely journaled on the journal section 40 of shaft 34 between frame arm sections 77, 78. Next to the gear 48 on the shaft section 40, a small spacer 144 separates an annular driver 146 from gear 48. Driver 146 is supported on the oblong section 42 of shaft 34 and has two diametrically spaced arms 148. Arms 148 extend perpendicularly from the annular main body 146*a* of the driver and are received in the arcuate slots 52 of the gear. Guide washers 150 on each side of a cam 152 isolate the cam from driver 146 and arm section 78 of the frame 76. Cam 152 has a teardrop configuration including an eccentric portion 154 intended for camming coaction with the cam follower portion 141 of lock member 138. The central apertures through driver 146, guide washers 150, and cam 152 have a configuration matching the configuration of component support section 42 of shaft 34 such that the driver, washers and cam rotate with the shaft 34 when handle 32 is pivoted. Gear 48 is journaled on shaft 34 and is rotated by the arms 148 of driver 146 contacting the ends of arcuate slots 52 in gear 48. Section 44 of shaft 34 prevents the shaft from being inserted too far into the frame. Section 44 is positioned between frame 76 and the inside surface of housing 11.

Figure 10:
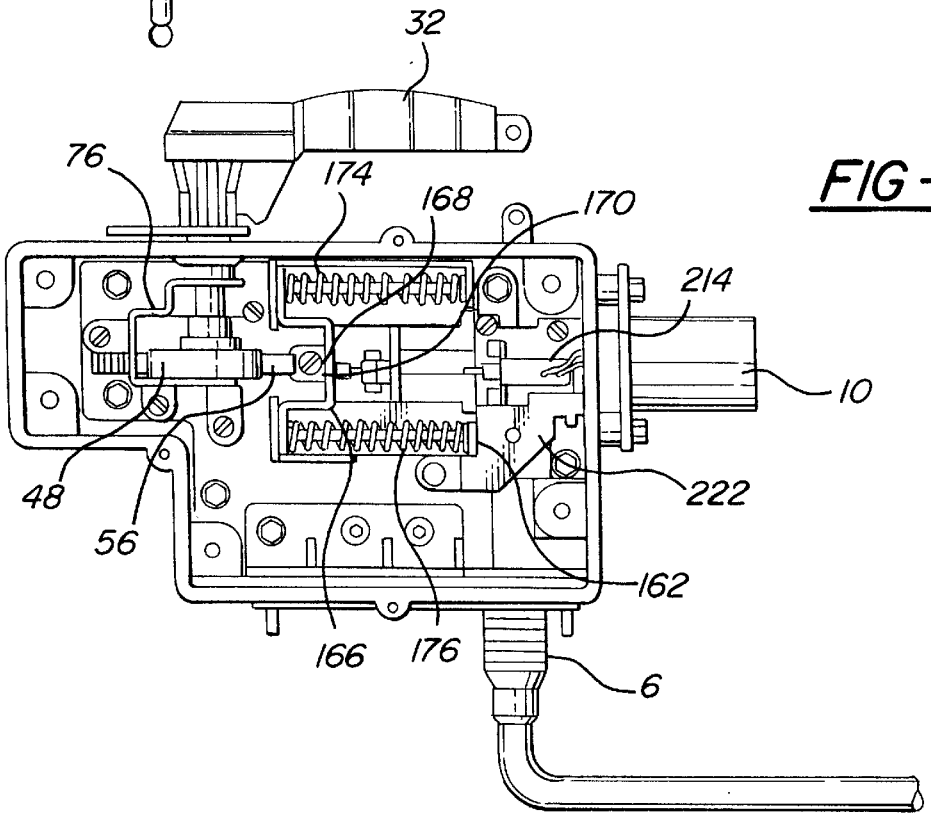
FIG. 10 is a partial top view of the switch mechanism shown in the disconnect position.
Figure 9:
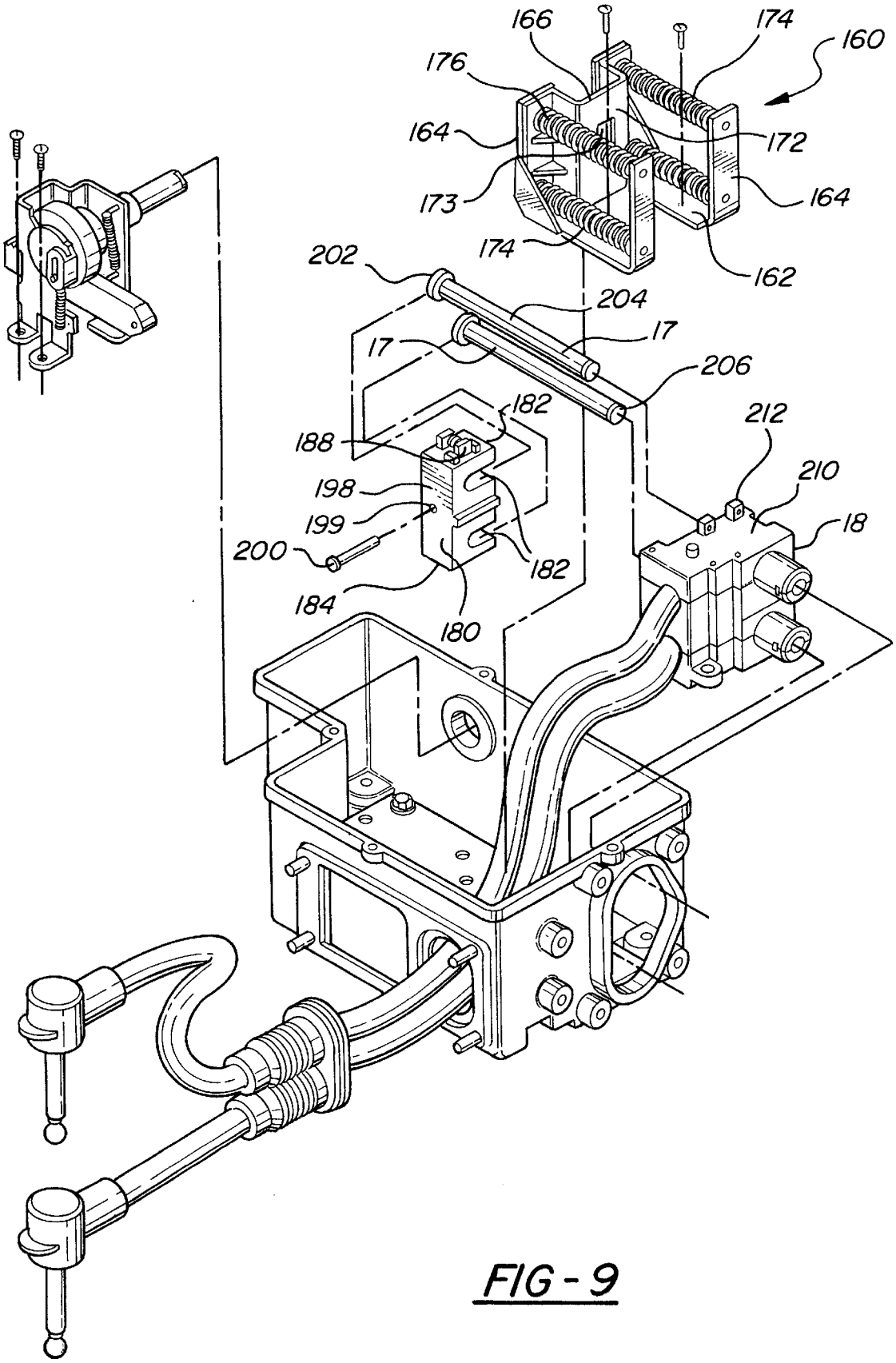
FIG. 9 is an exploded perspective view illustrating how components of the switch mechanism fit into a housing.

As illustrated in the exploded view of FIG. 9, gear rack 56 is associated with a contact support structure 160. Support structure 160 includes two main parts. A first part 162 is stationary and fixed to the base of the switch member. Part 162 has four upstanding legs 164, arranged two at each end, one at each corner. A second part 166 of support structure 160 comprises a U-shaped sliding part which moves toward and away from each set of upstanding legs 164 of fixed part 162. Sliding part 166 is pushed and pulled back and forth between the sets of upstanding legs 164 at each end of the fixed part 162 by linear movement of gear rack 56. To accomplish this, as best shown in FIG. 10, a bolt or a screw 168 extending through a tab 170 projecting from sliding part 166 toward frame 76 is turned into threaded hole 74 in upper surface 58 of gear rack 56. Sliding part 166 has a front surface 172 which faces the battery coupler subassembly 18. The apex of the U-shaped sliding part makes up a portion of the front surface 172 and has a large aperture 173 just below tab 170.

Sliding part 166 of support 160 is guided in its sliding movement between the ends of fixed part 162 by four rods 174, one at each corner of the support structure. Rods 174 are attached to upstanding legs 164 and extend from one end of the fixed part 162 to its other end. The rods 174 extend through four apertures adjacent the corners of sliding part 166. A coil spring 176 surrounds the outer diameter of each rod 174. Springs 176 are compressed between the surface 172 of sliding part 166 and upstanding legs 164 of fixed part 162 adjacent the battery coupler subassembly 18 when the sliding part is pushed toward the subassembly. Coil springs 176 bias sliding part 166 against the upstanding legs 164 of fixed part 162 adjacent the switch mechanism subassembly 30.

Figure 12:
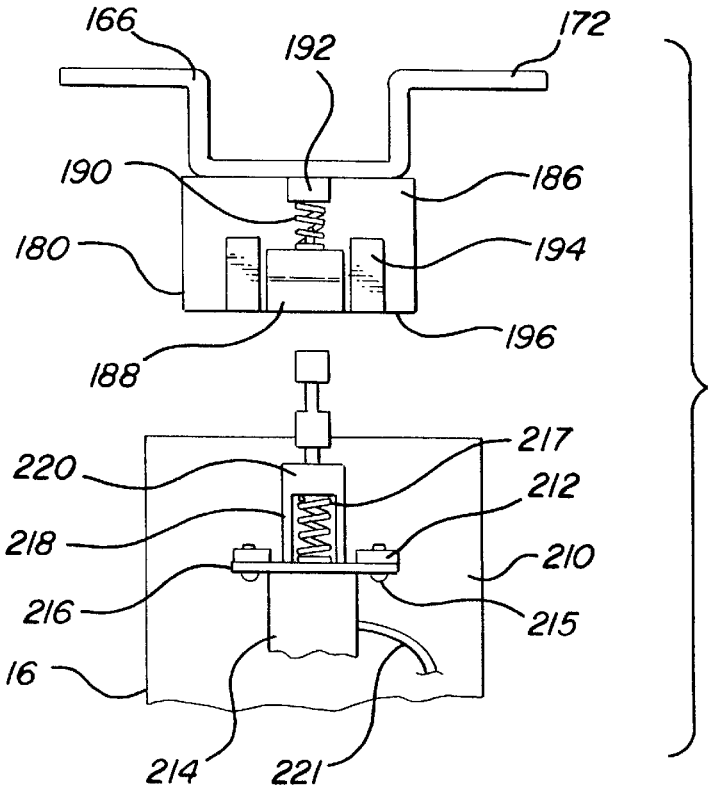
FIG. 12 is a top view of a switch depressor and power indicator switch used in the switch mechanism.

An electrically insulated plastic terminal mounting apparatus 180 is located near the front surface 172 at the apex of U-shaped sliding part 166. Apparatus 180 has two terminal furrows 182 between a lower side 184 and an upper side 186. On the upper side 186, as best shown in FIG. 12, is a switch depressor 188. Switch depressor 188 is spring loaded. A coil spring 190 extends between a block 192 fixed to the upper side 186 adjacent the front surface 172 of the sliding part 166 and depressor 188. Coil spring 190 is attached to both fixed block 192 and depressor 188 but the depressor is free to move. The depressor is guided in its movement by two walls 194 extending upward from the upper side 186 of the mounting apparatus 180. The depressor is positioned adjacent a front edge 196 of apparatus 180 which would approach the subassembly 18 as the sliding part 166 is advanced toward connector housing 15.

In the surface of mounting apparatus 180 facing the apex or front surface 172 of U-shaped sliding part 166 is an indentation 198 aligned with aperture 173. A bore 199 extends through the mounting apparatus from one side to the other and communicates with the indentation 198. The end 70 of gear rack 56 extends through aperture 173 into indentation 198. Aperture 72 in the gear rack aligns with bore 199. A pin 200 is inserted through bore 199 and aperture 72 and is secured in the bore in a conventional manner to attach end 70 of the gear rack to mounting apparatus 180. Gear rack 56 is thus secured to both sliding part 166 (by bolt 168 in tab 170) and to mounting apparatus 180 (by pin 200). This has the effect of joining mounting apparatus 180 to front surface 172 or apex of sliding part 166.

Male terminals or contacts 17 are generally pin-shaped with flat heads 202 and long shanks 204. The heads and a short portion of the shanks are received and secured in furrows 182 of mounting apparatus 180 such that the contact 17 move with the mounting apparatus 180. The ends 206 of shanks 204 distal from heads 202 are received in the battery cable couplers 20 clamped within the subassembly 18. The fit between the shanks 204 of the contact 17 and the annular passageways 24 of battery couplers 20 is snug enough such that reliable electrical contact is made between the contacts and the battery cable couplers.

Figure 11:
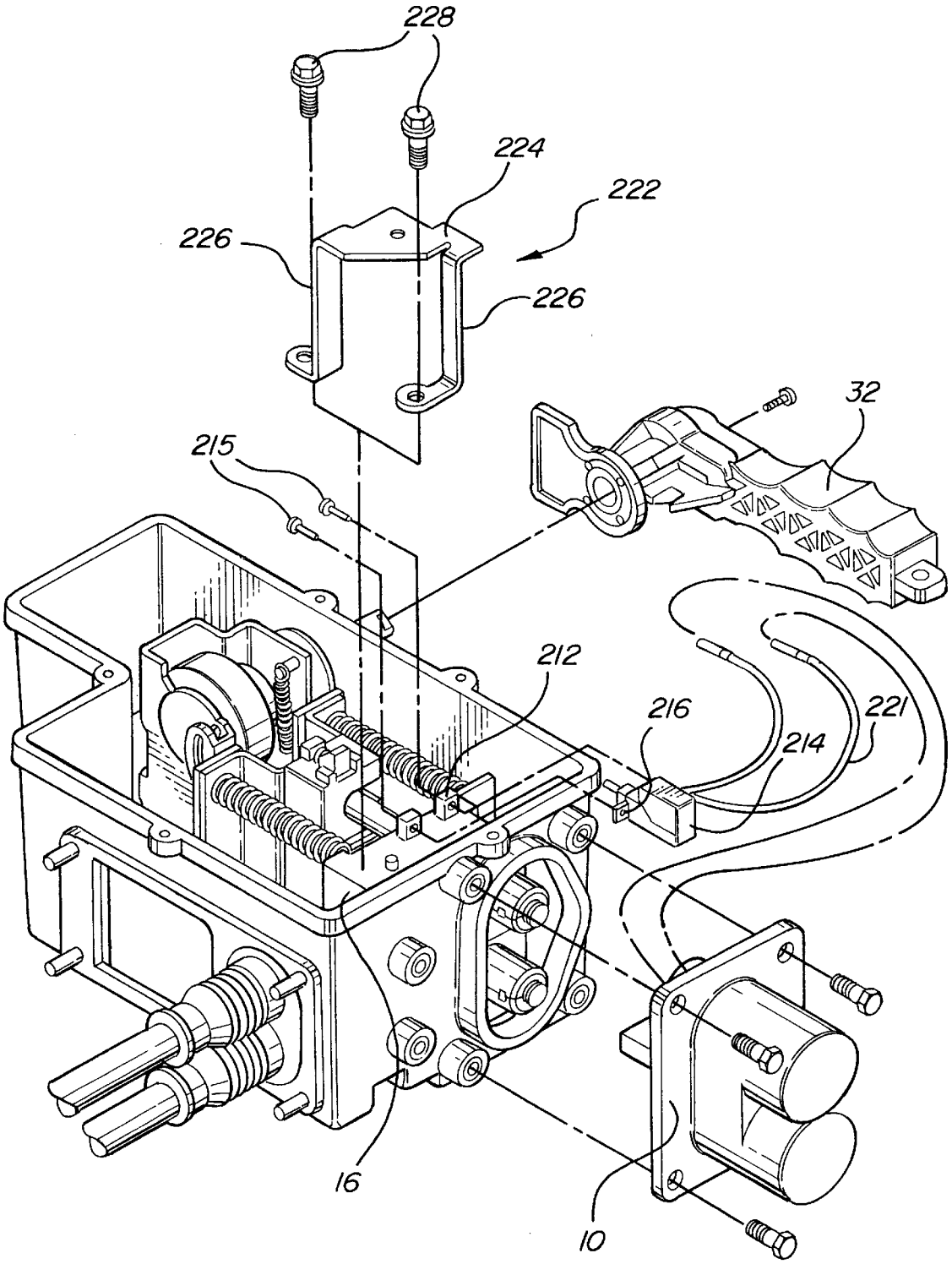
FIG. 11 is an exploded perspective view showing how the components of the switch mechanism are assembled.

As shown in FIGS. 9, 11 and 12, a top surface 210 of battery coupler subassembly 18 has two upstanding tabs 212. A power indicator switch 214 is secured to tabs 212 by screws 215 extending through matching tabs 216 projecting from the switch. Switch 214 is biased in a direction toward switch depressor 188 on upper side 186 of terminal mounting apparatus 180 by a spring 217 enclosed in a guide 218. A portion 220 of switch 214 is integral with guide 218. The switch is shown in the fully extended, open position. Guide 218 keeps the switch stable and in alignment with depressor 188. Two wire leads 221 extend from the switch to within the chamber 16 of the connector 15. When switch 214 is depressed by switch depressor 188, it signals the vehicle electrical system and the vehicle operator that electrical connection has been made between the contacts/terminals 17 and the vehicle electrical system terminals in the chambers 16 of the connector 15. Because switch depressor 188 is spring-loaded, it will not damage switch 214 when gear rack 56 moves terminal mounting apparatus 180 toward battery coupler subassembly 18.

A plate guide 222 (FIG. 11) is used to help properly position support 160 and switch 214 during assembly of the switch mechanism and to help securely anchor the battery coupler subassembly 18. The plate guide has a flat portion 224 which fits over part of the top surface 210 of subassembly 18 and two legs 226 which are secured at their lower ends by bolts 228 to the base of the switch mechanism.

To operate the battery connect/disconnect switch mechanism, handle 32 is gripped. In the disconnect position of the handle shown in FIGS. 1 and 10, battery couplers 20 are not electrically connected with the terminals from the vehicle electrical system in the chamber 16 of the connector 15. That is, the male terminals 17 are not in contact with the terminals in the chambers 16 so that the vehicle electrical system is disconnected from the battery.

To power the vehicle electrical system, handle 32 is pivoted upwardly from its switch open or disconnect position. As the handle is rotated, shaft 34 is turned. Cam 152 and driver 146 are also rotated but gear 48 does not rotate since gear 48 is freely journaled on shaft 34 and since arms 148 are positioned adjacent one end of arcuate slots 52 and move freely within the slots in lost motion fashion as the handle is pivoted upwardly. Arms 148 rotate with the driver 146 without turning gear 48 until the lost motion slack is taken up and the arms contact the opposite ends of the slots.

Until the handle reaches an upstanding, intermediate position (shown in dash lines in FIGS. 1 and 13), bridging pin 107 is at the bottom of slots 105 and walls 102 and 103 of channel 100 in plate stopper 94. As the plate stopper rotates with the shaft, spring 120 forces bridging pin 107 downward against the bottom of slots 105. If before handle 32 reaches the intermediate upstanding position the handle is released, the handle will return to the initial horizontal complete disconnect position under the bias of spring 120. This is a safety feature preventing inadvertent electrical connection. There is no electrical connection between the contact 17 and the terminals or contacts from the vehicle electrical system in the chamber 16 of the connector 15 in the upstanding position of the handle. The contacts 17 have not yet begun to move toward their connect position at this time.

Gear 48 begins to rotate after handle 32 passes the upstanding intermediate position and as arms 148 of driver 146 contact the ends of arcuate slots 52. Gear teeth 54 act on rack teeth 66 to move gear rack 56 in the direction of connector housing 15. Sliding part 166 and terminal mounting apparatus 180 are moved by the gear rack toward subassembly 18, inserting the contacts 17 further through battery couplers 20 toward the vehicle electrical system terminals in chambers 16 of connector housing 15. As the contacts moved toward subassembly 18, springs 176 around rod 174 are compressed between sliding part 166 and upstanding legs 164 of stationary part 162.

Figure 13:
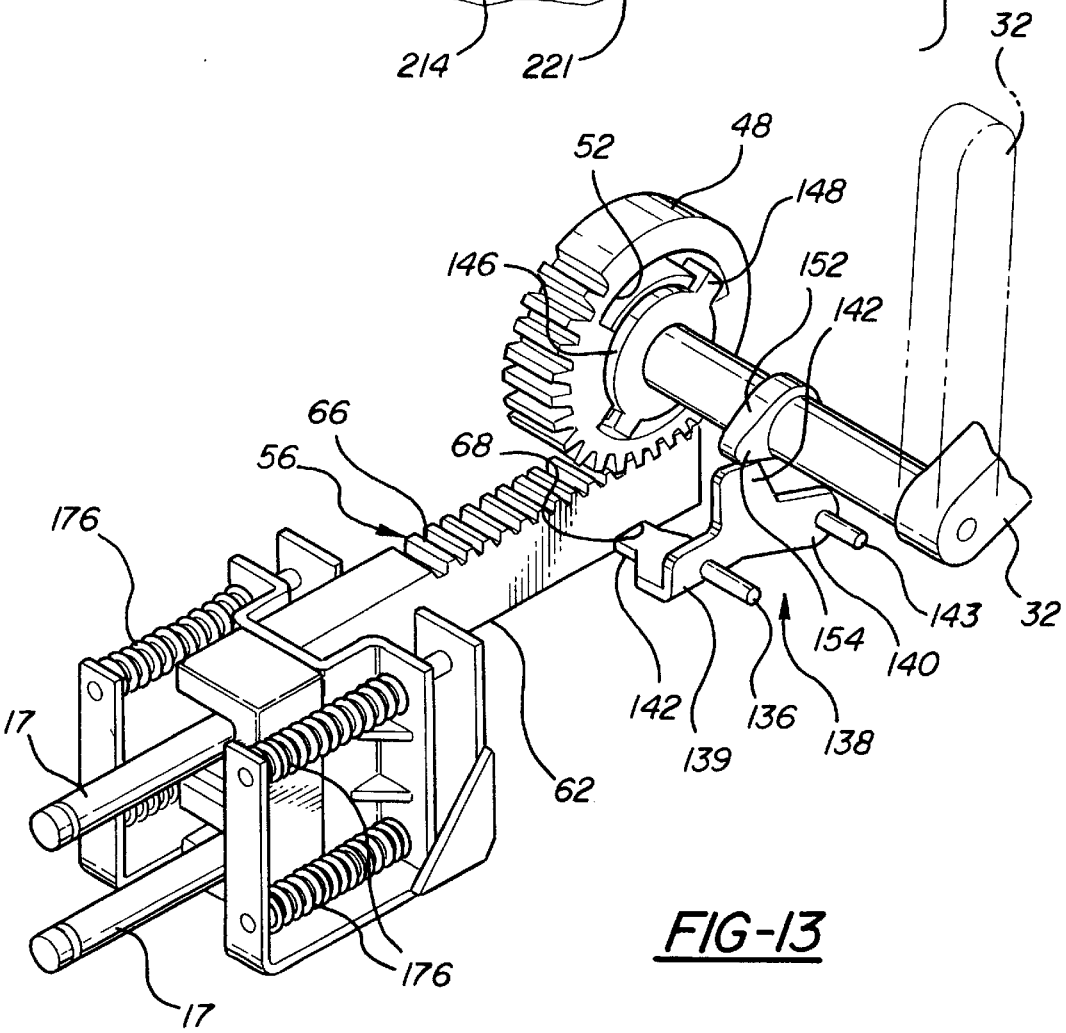
FIG. 13 is a fragmentary, perspective, somewhat schematic view of the switch mechanism shown in a connect position.

As handle 32 passes the intermediate upstanding position and begins to move toward the full connect position shown in FIG. 13, plate stopper 94 is at the top of its arc and channels 105 are momentarily parallel to the base of the device 10. The line of action of spring 120 now passes over center with respect to the axis of shaft 34 as bridging pin 107 slides along matching slots 105 and abuts against the opposite ends of the slots. Spring 120 now biases the handle toward the full connect position as the plate stopper continues to rotate with shaft 34. This biasing force is however smaller than the forces of springs 176 around rods 174. The pulling force of spring 120 helps reduce the torque needed to move the handle to the full connect position but the pushing forces of springs 176 must still be overcome. As the handle moves toward its full connect position springs 176 generate a force biasing the handle toward its upstanding electrical disconnect position.

Switch depressor 188 on the upper side 186 of terminal mounting apparatus 180 depresses switch 214 as the handle reaches a full electrical connect position and the contacts 17 mate with the vehicle electrical system terminals in the connector 15. Switch 214 confirms to the vehicle operator and the vehicle electrical monitoring system that the vehicle electrical system is connected to the battery pack when the vehicle ignition key is turned on.

The invention provides a lock for the full connect position of the contacts so that the gear rack cannot be retracted toward its disconnect position unless and until an initial triggering torque is applied to the handle to release the lock. The torque required is high enough to prevent accidental actuation of the switch. The locking action is provided by coaction of locking member 138 and the notch 68 in the under surface of the rack. Specifically, the detent tab 142 of locking member 138 slides along the under surface 62 of the gear rack 56 as the gear rack is moved in the direction of the connector 15. As handle 32 reaches the full connect position (FIG. 13), detent tab 142, through the action of spring 130, snaps upwardly into gear rack notch 68.

When the handle is subsequently rotated in the opposite direction from the connect position of FIG. 13 toward the disconnect position of FIGS. 1 and 10, arms 148 of driver 146 are moved by shaft 34 away from one end of slots 52 and move freely in the slots toward the opposite ends of the slots, while at the same time cam 152 rotates with shaft 34. Just before the arms 148 reach the opposite ends of slots 52, and as the handle approaches its upright intermediate position, eccentric portion 154 of cam 152 engages lock member cam follower portion 141 and pivots cam follower portion 141 downwardly against the bias of spring 130 about the axis of pin 143. This pivots detent tab 142 out of rack notch 68 and enables the rack to snappingly retract under the biasing force of compressed springs 176 and snappingly move contacts 17 to their disconnect positions. This rapid snapping disconnect movement of the rack and contacts is accommodated by the lost motion connection between gear 48 and rack 56. Specifically, as the unwinding springs 176 power the rack toward the disconnect position, the gear does not resist or impede this movement and no motion is imparted to handle 34 since the disconnect movement of the rack is accommodated by lost motion movement of slots 52 relative to driver arms 148. The parameters of the switch are such that as the ends of slots 52 approach arms 148, the disconnect movement of the rack/contacts is abruptly and positively halted by the engagement of moveable frame part 166 with fixed frame part 164.

Note that the lost motion connection provided by arms 148 and arcuate slots 52, in addition to allowing the rapid snapping disconnect of the contacts under the biasing force of compressed springs 176, also requires that the handle be moved through a large angular distance, for example 90°, before any actual connect or disconnect movement of the contacts is achieved. This is a safety feature and discourages accidental or inadvertent actuation of the switch in either a connect or disconnect manner.

As handle 32 is pivoted upwardly from its connect position toward its intermediate upstanding position to release detent tab 142, pin 107 slides in slots 105 to move spring 120 over center with respect to the axis of shaft 34 whereby to pull the handle to the full disconnect position shown in FIGS. 1 and 10 under the bias of spring 120.

The switch mechanism of the invention will be seen to provide many important advantages. Specifically, the contacts can only remain in the two extreme positions, either fully connected or fully disconnected; accidental or inadvertent actuation of the switch is discouraged; only a small initial torque is required to actuate the switch in a disconnect sense; and a positive and precise snap action is provided for quickly attaining the full disconnect position. The switch mechanism of the invention is therefore especially well suited for high current applications such as disconnecting the electrical system of an electric vehicle from the battery pack of the vehicle.

Whereas a preferred embodiment of the invention has been illustrated and described in detail, it will be apparent that various changes may be made in the disclosed embodiment without departing from the scope or spirit of the invention.

The invention claimed is:

1. A disconnect switch mechanism for an electrical circuit comprising:

a contact mounted for movement between a closed position in which the circuit is closed and an open position in which the circuit is open;

actuator means moveable in a switch open direction and a switch closed direction;

drive means operative in response to movement of the actuator means in a switch closed direction to move the contact from its open to its closed position;

biasing means operative in response to movement of the contact to its closed position to generate a force biasing the contact toward its open position;

detent means operative in response to arrival of the contact at its closed position to prevent movement of the contact to its open position irrespective of the biasing force;

release means operative in response to movement of the actuator means in a switch open direction to release the detent means; and means operative upon release of the detent means to allow movement of the contact independently of movement of the actuator means whereby to allow the biasing force to move the contact to its open position.

2. A switch mechanism according to claim 1 wherein the biasing means includes a coil spring which is compressed in response to movement of the contact to its closed position.

3. A switch mechanism for connecting and disconnecting an electrical system from a power source, the switch mechanism comprising:

a contact mounted for movement between a closed, connect position in which the system and source are connected and an open, disconnect position in which the system and source are disconnected;

actuator means moveable in a switch open direction and a switch closed direction;

drive means, including a lost motion connection, operative in response to movement of the actuator means in a switch closed direction to move the contact from its open to its closed position;

biasing means operative in response to movement of the contact to its closed position to generate a force biasing the contact toward its open position;

detent means operative in response to arrival of the contact at its closed position to prevent movement of the contact to its open position irrespective of the biasing force; and release means operative in response to movement of the actuator means in a switch open direction to release the detent means to allow the biasing force to move the contact to its open position with the movement of the contact allowed by the lost motion connection in the drive means.

4. A disconnect switch according to claim 3 wherein:

the actuator means includes a handle mounted for movement between an open position corresponding to the open position of the contact, a closed position corresponding to the closed position of the contact, and an intermediate position; and the switch mechanism further includes resilient means operative to urge the handle towards its open position in response to movement of the handle from its open to its closed position and operative to urge the handle toward its closed position upon passage of the handle through its intermediate position.

5. A switch mechanism according to claim 4 wherein:

the actuator means further includes a shaft;

the handle is secured to the shaft and is mounted for pivotal movement about the pivot axis of the shaft between its open, closed, and intermediate positions; and the resilient means includes a spring having a line of action which passes over center with respect to the pivot axis of the shaft as the handle passes through its intermediate position.

6. A switch mechanism according to claim 3 wherein the biasing means includes a coil spring which is compressed in response to movement of the contact to its closed position.

7. A switch mechanism according to claim 3 wherein:

the actuator means includes a shaft;

the drive means includes a gear mounted on the axis of the shaft and a rack driven by the gear and connected to the contact; and the lost motion connection is provided between the shaft and the gear.

8. A switch mechanism according to claim 7 wherein:

the actuator means further includes a handle connected to the shaft; and the lost motion connection includes a driver carried by the shaft and received in an arcuate slot in the gear.

9. A switch mechanism according to claim 8 wherein:

the contact comprises a pin extending parallel to the line of action of the rack; and the biasing means comprises a coil spring having a line of action parallel to the pin and to the line of action of the rack.

10. A switch mechanism according to claim 3 wherein:

the actuating means includes a shaft;

the drive means includes a gear mounted on the shaft and a rack driven by the gear;

the detent means includes a notch in the rack and a detent operative to engage the notch in response to movement of the contact to its closed position;

the release means includes a cam member carried by the shaft and operative to release the detent from the notch in response to rotation of the shaft; and the lost motion connection comprises a driver carried by the shaft and received in an arcuate slot in the gear.

11. A disconnect switch mechanism for an electrical circuit comprising a contact mounted for movement between a closed position in which the circuit is closed and an open position in which the circuit is open, a handle moveable between a switch open position and a switch closed position, and drive means operative in response to movement of the handle between its switch open and switch closed positions to move the contact between its open and closed positions; characterized in that:

the drive means includes a lost motion connection operative to allow movement of the handle from its switch open position to an intermediate position, and from its switch closed position to the intermediate position, without movement of the contact, whereby to prevent inadvertent actuation of the switch mechanism; and the switch mechanism further includes detent means operative in response to movement of the contact to its closed position to engage the contact to preclude movement of the contact toward its open position, and release means operative in response to movement of the handle from its switch closed position to its intermediate position to release the detent means and allow the contact to move toward its open position.

12. A method of performing a switching operation in a switch mechanism for an electrical circuit, the switch mechanism including a contact mounted for movement between a closed position in which the circuit is closed and an open position in which the circuit is open, actuator means moveable in a switch open direction and a switch closed direction, and drive means operative in response to movement of the actuator means in a switch closed direction to move the contact from its open to its closed position; the method comprising:

moving the actuator member in a switch close direction to move the contact from its open to its closed position;

generating a force biasing the contact toward its open position in response to movement of the contact to its closed position;

lockingly engaging the contact in response to arrival of the contact at its closed position to prevent movement of the contact to its open position irrespective of the biasing force;

releasing the contact in response to movement of the actuator means in a switch open direction; and drivingly disconnecting the actuator means from the contact upon release of the contact to allow the biasing force to move the contact to its open position.

13. A disconnect switch mechanism for an electrical circuit comprising:

a contact mounted for movement between a closed position in which the circuit is closed and an open position in which the circuit is open;

actuator means moveable in a switch open direction and a switch closed direction;

drive means operative in response to movement of the actuator means in a switch closed direction to move the contact from its open to its closed position;

biasing means operative in response to movement of the contact to its closed position to generate a force biasing the contact toward its open position;

detent means operative in response to arrival of the contact at its closed position to prevent movement of the contact to its open position irrespective of the biasing force; and release means operative in response to movement of the actuator means in a switch open direction to release the detent means to allow the biasing force to move the contact to its open position;

the drive means including a driven member moving with the contact;

the actuator means including a driving member;

a lost motion connection being provided between the driving and driven members which is operative to allow movement of the driven member relative to the driving member whereby to allow the contact to move to its open position under the biasing force without moving the driving member.

14. A disconnect switch according to claim 13 wherein the actuator means further includes a handle operative to actuate the driving member.

15. A disconnect switch according to claim 14 wherein:

the handle is mounted for movement between an open position corresponding to the open position of the contact, a closed position corresponding to the closed position of the contact, and an intermediate position; and the switch mechanism further includes resilient means operative to urge the handle toward its open position in response to movement of the handle from its open toward its closed position and operative to urge the handle toward its closed position upon passage of the handle through its intermediate position.

16. A switch mechanism according to claim 15 wherein:

the actuator means further includes a shaft;

the handle is secured to the shaft and is mounted for pivotal movement about the pivot axis of the shaft between its open, closed and intermediate positions; and the resilient means includes a spring having a line of action which passes over center with respect to the pivot axis of the shaft as the handle member passes through its intermediate position.

17. A disconnect switch mechanism for an electrical circuit comprising:

a contact mounted for movement between a closed position in which the circuit is closed and an open position in which the circuit is open;

actuator means moveable in a switch open direction and a switch closed direction;

drive means operative in response to movement of the actuator means in a switch closed direction to move the contact from its open to its closed position;

biasing means operative in response to movement of the contact to its closed position to generate a force biasing the contact toward its open position;

detent means operative in response to arrival of the contact at its closed position to prevent movement of the contact to its open position irrespective of the biasing force; and release means operative in response to movement of the actuator means in a switch open direction to release the detent means to allow the biasing force to move the contact to its open position;

the actuator means including a shaft;

the drive means including a gear mounted on the axis of the shaft and a rack driven by the gear and connected to the contact;

the switch means further including a lost motion connection between the shaft and the gear.

18. A switch mechanism according to claim 17 wherein:

the actuator means further includes a handle connected to the shaft; and the lost motion connection includes a driver carried by the shaft and received in an arcuate slot in the gear.

19. A switch mechanism according to claim 18 wherein:

the contact comprises a pin extending parallel to the line of action of the rack; and the biasing means comprises a coil spring having a line of action parallel to the pin and to the line of action of the rack.

20. A disconnect switch mechanism for an electrical circuit comprising:

a contact mounted for movement between a closed position in which the circuit is closed and an open position in which the circuit is open;

actuator means moveable in a switch open direction and a switch closed direction;

drive means operative in response to movement of the actuator means in a switch closed direction to move the contact from its open to its closed position;

biasing means operative in response to movement of the contact to its closed position to generate a force biasing the contact toward its open position;

detent means operative in response to arrival of the contact at its closed position to prevent movement of the contact to its open position irrespective of the biasing force; and release means operative in response to movement of the actuator means in a switch open direction to release the detent means to allow the biasing force to move the contact to its open position;

the actuator means including a shaft;

the drive means including a gear mounted on the shaft and a rack driven by the gear;

the detent means including a notch in the rack and a detent member operative to engage the notch in response to movement of the contact to its closed position;

the release means including a cam member carried by the shaft and operative to release the detent from the notch in response to rotation of the shaft.

21. A disconnect switch mechanism for an electrical circuit comprising a contact mounted for movement between a closed position in which the circuit is closed and an open position in which the circuit is open, a handle moveable between a switch open position and a switch closed position, and drive means operative in response to movement of the handle between its switch open and switch closed positions to move the contact between its open and closed positions; characterized in that:

the drive means includes a lost motion connection operative to allow movement of the handle from its switch open position to an intermediate position, and from its switch closed position to the intermediate position, without movement of the contact, whereby to prevent inadvertent actuation of the switch mechanism; and the switch mechanism further includes resilient means operative to urge the handle toward its open position upon release of the handle after movement of the handle from its open position to any position between the open position and the intermediate position, and operative to urge the handle toward its closed position upon release of the handle after movement of the handle from its closed position to any position between the closed position and the intermediate position.

22. A switch mechanism according to claim 21 wherein:

the switch mechanism further includes a shaft;

the handle is secured to the shaft and is mounted for pivotal movement about the pivot axis of the shaft between its open, closed and intermediate positions; and the resilient means includes a spring having a line of action which passes over center with respect to the pivot axis of the shaft as the handle passes through its intermediate position.

23. A switch mechanism according to claim 22 wherein:

the drive means includes a gear journaled on the shaft; and the lost motion connection is provided between the shaft and the gear.

24. A switch mechanism according to claim 23 wherein the lost motion connection includes a driver carried by the shaft received in an arcuate slot in the gear.

25. A switch mechanism according to claim 24 wherein the drive means further includes a rack connected to the contact and driven by the gear.

26. A switch mechanism according to claim 25 wherein the switch mechanism further includes:

biasing means operative in response to movement of the contact to its closed position to generate a force biasing the contact toward its open position;

detent means operative in response to movement of the contact from its closed position to prevent movement of the contact to its open position irrespective of the biasing force; and release means operative in response to movement of the handle in a switch open direction to release the detent means to allow the biasing force to move the contact to its open position with the movement of the contact to its open position being accommodated by the lost motion connection.

27. A switch mechanism according to claim 26 wherein:

the detent means includes a notch in the rack and a detent member operative to engage the notch in response to movement of the contact to its closed position; and the release means includes a cam member carried by the shaft and operative to release the detent from the notch in response to rotation of the shaft.

28. A switch mechanism according to claim 21 wherein the switch mechanism further includes:

biasing means operative in response to movement of the contact to its closed position to generate a force biasing the contact toward its open position;

detent means operative in response to arrival of the contact at its closed position to prevent movement of the contact to its open position irrespective of the biasing force; and release means operative in response to movement of the handle from its closed position and through its intermediate position to release the detent means to allow the biasing force to move the contact to its open position with the contact movement being accommodated by the lost motion connection.

29. A switch mechanism according to claim 28 wherein:

the switch mechanism further includes a shaft;

the handle is secured to the shaft and is mounted for pivotal movement about the pivot axis of the shaft between its open, closed and intermediate positions; and the resilient means includes a spring having a line of action which passes over center with respect to the pivot axis of the shaft as the handle passes through its intermediate position.

30. A method of performing a switching operation in a switch mechanism for an electrical circuit, the switch mechanism including a contact mounted for movement between a closed position in which the circuit is closed and an open position in which the circuit is open, actuator means moveable in a switch open direction and a switch closed direction, and drive means operative in response to movement of the actuator means in a switch closed direction to move the contact from its open to its closed position; the method comprising:

moving the actuator member in a switch closed direction to move the contact from its open to its closed position;

generating a force biasing the contact toward its open position in response to movement of the contact to its closed position;

lockingly engaging the contact in response to arrival of the contact at its closed position to prevent movement of the contact to its open position irrespective of the biasing force;

releasing the contact in response to movement of the actuator means in a switch open direction; and providing a lost motion connection in the drive means operative to allow the contact to be moved to its open position by the biasing force in response to release of the contact.

* * * * *

UNITED STATES PATENT AND TRADEMARK OFFICE

CERTIFICATE OF CORRECTION

PATENT NO. : 5,850,909

DATED : December 22, 1998

INVENTOR(S) : Brian L. Wagner

It is certified that error appears in the above-identified patent and that said Letters Patent is hereby corrected as shown below:

Title page, insert, item [73], --Assignee: Yazaki Corporation, Tokyo, Japan --.

Signed and Sealed this

Fifth Day of October, 1999

*Attest:*

*Attesting Officer*

Q. TODD DICKINSON

*Acting Commissioner of Patents and Trademarks*